US007518585B2

(12) United States Patent
Onoda

(10) Patent No.: US 7,518,585 B2
(45) Date of Patent: Apr. 14, 2009

(54) ORGANIC EL DISPLAY DEVICE AND METHOD OF DRIVING THE DEVICE

(75) Inventor: Takatoshi Onoda, Kanagawa (JP)

(73) Assignee: Fuji Electric Holdings Co., Ltd. (JP)

( * ) Notice: Subject to any disclaimer, the term of this patent is extended or adjusted under 35 U.S.C. 154(b) by 167 days.

(21) Appl. No.: 11/358,948

(22) Filed: Feb. 21, 2006

(65) Prior Publication Data

US 2006/0202633 A1 Sep. 14, 2006

(30) Foreign Application Priority Data

Feb. 18, 2005 (JP) ..... 2005-041670

(51) Int. Cl.
*G09G 3/36* (2006.01)

(52) U.S. Cl. ..... 345/92; 345/90; 345/76; 345/84; 345/77; 315/169.3

(58) Field of Classification Search ..... 315/169.3, 315/160, 167, 168, 169.1, 169.2, 169.4, 224, 315/291, 307; 345/204, 205, 211, 212, 213, 345/214, 76, 77, 82, 36, 45, 48, 55, 60, 61, 345/63, 66, 67, 68, 74.1, 75.1, 75.2, 78, 79, 345/80, 83, 84, 87, 89, 90, 92, 93, 98, 100, 345/102, 206, 208, 210, 690, 691; 313/112, 313/243, 309, 310, 495, 498, 500, 503, 504, 313/505, 506, 509, 511, 512
See application file for complete search history.

(56) References Cited

U.S. PATENT DOCUMENTS 5,369,338 A * 11/1994 Kim ..... 315/169.4

FOREIGN PATENT DOCUMENTS

| | | | |
|---|---|---|---|
| CN | 1441399 | A | 9/2003 |
| EP | 1341147 | A2 | 3/2003 |
| EP | 1341147 | A2 * | 9/2003 |
| JP | 9-232074 | A | 9/1997 |

OTHER PUBLICATIONS

European Search Report—corresponding application 06003151.5-2205.

Notice on office action issued in corresponding Chinese application No: 200610009087.4, dated Sep. 5, 2008.

*Primary Examiner*—Douglas W Owens
*Assistant Examiner*—Jae K Kim
(74) *Attorney, Agent, or Firm*—Rossi, Kimms & McDowell LLP

(57) ABSTRACT

An organic EL display device is disclosed that prevents charging and discharging that do not contribute to light emission, thereby reducing power consumption. The organic EL display device comprises a plurality of first electrode elements, a plurality of second electrode elements crossing the first electrode elements, and organic light emitting layers sandwiched by the first electrode elements and the second electrode elements. A first driving unit passes light emitting current through the first electrode elements. A second driving unit connects the second electrode elements to the ground to pass the light emitting current and to a second power supply not to pass the light emitting current. The voltage of the second power supply is varied in synchronism with the voltage waveform of output of the light emitting current from the first driving unit.

(Continued)

5 Claims, 11 Drawing Sheets

U.S. PATENT DOCUMENTS 5,719,589 A * 2/1998 Norman et al. ..... 345/82
5,828,181 A * 10/1998 Okuda ..... 315/169.3
5,844,368 A * 12/1998 Okuda et al. ..... 315/169.3
6,201,520 B1 * 3/2001 Iketsu et al. ..... 345/76
6,714,177 B1 * 3/2004 Ishizuka ..... 345/76
6,803,729 B2 * 10/2004 Muruyama ..... 315/169.1
6,836,068 B2 * 12/2004 Furugori et al. ..... 313/506
2002/0169575 A1 11/2002 Everitt
2004/0155842 A1 8/2004 Ishizuka
2005/0104822 A1 * 5/2005 Seki ..... 345/82

* cited by examiner

ORGANIC EL DISPLAY DEVICE AND METHOD OF DRIVING THE DEVICE

CROSS REFERENCE TO RELATED APPLICATIONS

This application is based on, and claims priority to, Japanese Application No. 2005-041670, filed on Feb. 18, 2005, the contents of which are incorporated herein by reference.

BACKGROUND OF THE INVENTION

A. Field of the Invention

The present invention relates to an organic EL display device and a method of driving the device, in particular, to a passive matrix type organic EL display device that exhibits enhanced brightness and reduced power consumption and a method of driving such a device.

B. Description of the Related Art

An organic EL display device performs high visibility owing to the self light emitting nature and low voltage driving ability thereof. Accordingly, it is being actively researched for practical applications. A type of known organic EL light emitting element composing each pixel of an organic EL display device comprises an anode of a transparent conductive film formed on a transparent substrate and an organic layer consisting of a hole transport layer and a light emitting layer (an organic layer of two layer structure). In another known structure, the organic layer consists of three layers: a hole transport layer, a light emitting layer, and an electron transport layer.

The light emitting mechanism of an organic EL light emitting element is considered as follows. An exciton is generated in a fluorescent dye molecule of the light emitting layer with an electron injected from a cathode and a hole injected from an anode. Light emission occurs in a process of irradiating recombination of the exciton. The generated light is emitted through the anode of a transparent conductive film and the transparent substrate.

A passive matrix type (simple matrix type) display device as shown in FIG. 8 is one of the display devices using organic EL light emitting elements. A passive matrix type organic EL display device comprises a plurality of anode elements on a transparent substrate, a plurality of cathode elements perpendicular to the anode elements, and an organic layer including organic light emitting layers sandwiched by these electrode elements. Each pixel is formed at a crossing point of an anode element and a cathode element. A plurality of pixels are arranged to form a display area. The anode and cathode elements are formed extending from the display area to a periphery of the substrate. The extended parts are connection parts connecting to a driver circuit. The connection parts connect to an external driver circuit, to construct an organic EL display device. Research recently has been done on high precision colored passive matrix type organic EL display devices that take advantage of quick response at light emission of an organic EL light emitting device. The organic EL displays are highly expected to achieve high quality display such as full color display and moving image display at a low cost in various application fields of information apparatuses.

As described previously, an organic EL light emitting device is a device utilizing light emission by current injection, and requires a driver circuit that controls a larger current than in electric field-driven devices such as liquid crystal display devices, and an anode and a cathode that allow conduction of such a large current. For electrodes of the passive matrix type organic EL display devices, an anode is made of a transparent conductive metal oxide such as indium tin oxide (ITO), indium lead oxide, or tin oxide, and a cathode is made of a low work function metal such as an aluminum alloy or a magnesium alloy.

Japanese Laid-open Publication No. H9-232074 discloses a technique to reduce power consumption associated with operation of a passive matrix type organic EL display device.

A passive matrix type organic EL display device having X×Y pixels in the display area must drive all pixels in the display area by X+Y electrodes of anodes and cathodes all together. Consequently, the pixels other than the pixels selected in scanning operation by the driver circuit are also influenced by the electric potential of the electrodes (for example, anodes) connecting to the selected pixels.

In a specific case with cathodes of scanning electrode elements of which an electrode element is selected at a moment, and anodes of data electrode elements in the direction crossing the scanning electrode elements, a passive matrix type organic EL display device is operated by a push-pull type driver circuit that changes the connection point of the electrode elements by means of a switching element. In this case, one of the scanning electrode elements (cathodes) is selected and connected to the ground by the switching element. A voltage (forward voltage) for light emission of the organic EL light emitting element is applied by this selected scanning electrode element and a data electrode element (anode) connected to a display current source by a switching element. Scanning electrode elements that are not selected are connected to a bias power supply by switching elements. A reverse bias voltage is applied to the organic EL light emitting element of an unselected scanning electrode element by the unselected scanning electrode element and a data electrode element connected to the ground by a switching element. After a display is accomplished in a selected scanning electrode element, a selected electrode element is switched sequentially. An organic EL light emitting element, having a structure with an organic light emitting layer sandwiched by electrode elements, has a large capacitor component parallel to a diode component. Charging and discharging of the large capacitor component occur due to the forward voltage and the reverse bias voltage at every time of switching of a selected scanning electrode element.

The charging and discharging are described more in detail below. In a passive matrix type organic EL display device in a display operation, one scanning electrode element is selected for a certain period and the other scanning electrode elements are not selected in this period. Almost throughout the period, the organic EL light emitting elements driven by unselected scanning electrode elements are subjected to a reverse bias voltage. This is because the switching elements are controlled to set the data electrode element at the ground potential, the selected scanning electrode element at the ground potential, and the unselected scanning electrode elements at the potential of the power supply. In this period, the data electrode element is connected to the potential of the power supply to light the organic EL light emitting element and light emitting current flows in the organic EL light emitting element connecting to the selected scanning electrode element. At this time, the capacitor component of the organic EL light emitting element is charged, and at the same time, the organic EL light emitting element connecting to an unselected scanning electrode element is also charged by the reverse bias voltage. As a result, a problem arises that sufficient charges cannot be supplied to the organic EL light emitting element to be lighted. If the driver circuit for supplying charges to anode elements is a constant current type, the charging process takes more time and the desired brightness can not be attained during that transient period, thus, average brightness is decreased. Accordingly, a magnitude of the constant current is set at a higher level to ensure a desired average brightness. The organic EL light emitting element suffers degradation in electric current efficiency, an increase in power consumption, and a shortening of operation life. In addition, the power loss due to charging and discharging on every switching of selected scanning electrode element cannot be ignored.

To solve this problem, Japanese Unexamined Patent Application Publication No. H9-232074 discloses a method of cathode reset. In the process of switching the selected scanning electrode element (cathode element) to the next, at first, every scanning electrode element is once connected to the power supply at the ground potential. Thereby, the subsequently selected scanning electrode element receives charges through other scanning electrode elements, accumulating charges in some amount before lighting. In the method of cathode reset, however, a large inrush current flows into the lighting organic EL light emitting element from the unselected scanning electrode elements all at once, which raises the problem of a heavy load on the driver IC. Further in the method of cathode reset, the power source potential of the scanning electrode elements must be set lower than the power source potential of the data electrode anode elements, and avoid light emission in the pixels.

The present invention is directed to overcoming or at least reducing the effects of one or more of the problems set forth above.

SUMMARY OF THE INVENTION

It is an object of the present invention to provide an organic EL display device and an operation method thereof in which input of charges into unselected pixels is decreased to suppress power consumption and enhance brightness of the lighting pixels.

To achieve this and other objects, the present invention provides an organic EL display device comprising a plurality of first electrode elements a plurality of second electrode elements arranged in a shape of stripes and in a direction crossing the first electrode elements, each crossing point forming a pixel; organic light emitting layers sandwiched by the first electrode elements and the second electrode elements; a first driving unit to pass light emitting current corresponding to a display pattern through the first electrode elements; a second driving unit connecting to the second electrode elements, the second driving unit selecting one of the second electrode elements corresponding to a pixel through which light emitting current is allowed to flow by the first driving unit and connect the selected second electrode element to a ground or a first power supply that causes the light emitting current to flow in cooperation with the first driving unit, and the second driving unit connecting the unselected second electrode element to a second power supply to prevent the light emitting current to flow; wherein a voltage of the second power supply is changed in synchronism with a voltage wave form of output of the light emitting current from the first driving unit.

The present invention also provides a method of driving an organic EL display device that comprises a plurality of first electrode elements arranged in a shape of stripes; a plurality of second electrode elements arranged in a shape of stripes and in a direction crossing the first electrode elements, each crossing point forming a pixel; organic light emitting layers sandwiched by the first electrode elements and the second electrode elements; a first driving unit to pass light emitting current corresponding to a display pattern through the first electrode elements; a second driving unit connecting to the second electrode elements, the second driving unit selecting one of the second electrode elements corresponding to a pixel through which light emitting current is allowed to flow by the first driving unit and connect the selected second electrode element to a ground or a first power supply that causes the light emitting current to flow in cooperation with the first driving unit, and the second driving unit connecting the unselected second electrode element to a second power supply to prevent the light emitting current to flow; the method comprising steps of: selecting one of the second electrode elements and electrically connecting to the first power supply or the ground; subsequently, by the first driving unit, outputting the light emitting current through a first electrode element to the organic EL light emitting element that connects to the selected second electrode element and then stopping the light emitting current; subsequently separating the selected electrode element from the first power supply or the ground; and electrically connecting the second electrode elements other than the selected second electrode element to the first power supply or the ground; wherein a voltage of the second power supply is changed in synchronism with a voltage wave form of output of the light emitting current from the first driving unit.

By changing the voltage of the second power supply in synchronism with the voltage wave form of the first driving unit, the amount of charges in unselected pixels due to the reverse bias voltage is reduced and the charges to the lighting pixel are effectively supplied. Thus, enhancement of brightness and reduction of power consumption can be achieved in a passive matrix type organic EL display device.

BRIEF DESCRIPTION OF THE DRAWINGS

The foregoing advantages and features of the invention will become apparent upon reference to the following detailed description and the accompanying drawings, of which.

DETAILED DESCRIPTION OF SPECIFIC EMBODIMENTS

First Aspect of Embodiment

Figure 1:
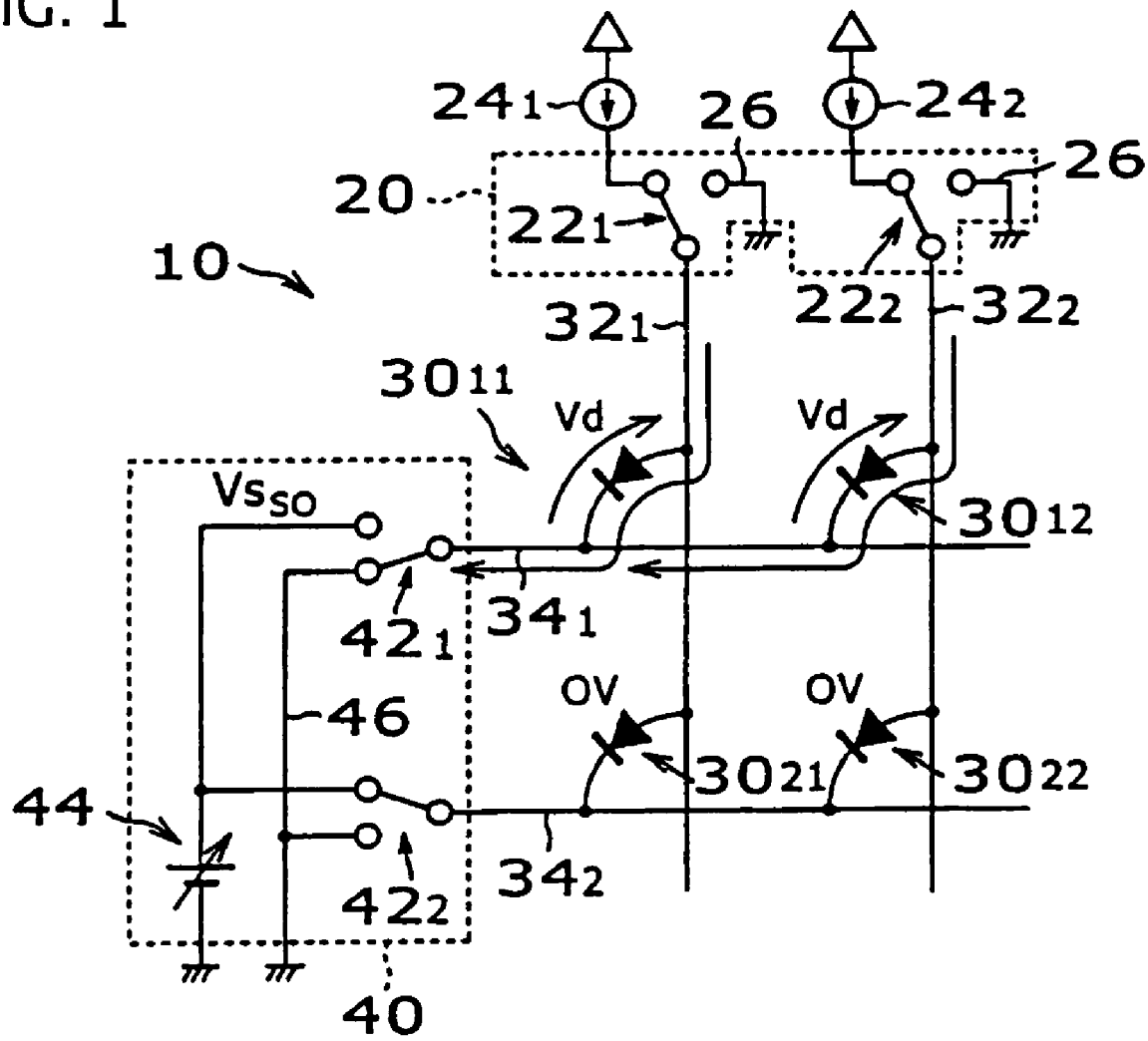
FIG. 1 is a circuit diagram showing a part of a structure of an organic EL display device of an embodiment according to the invention, and shows a state of switches in the intermediate stage in the selected period.

FIGS. 1 through 4 are circuit diagrams showing a part of organic EL display device 10 of an embodiment according to the invention. The figures show the current through pixels and the voltage across pixels when a scanning electrode element is selected and switched to another scanning electrode element. The figures illustrate operation of the organic EL display device 10 referring to 2×2 organic EL light emitting elements $\mathbf{30}_{11}$, $\mathbf{30}_{12}$, $\mathbf{30}_{21}$, and $\mathbf{30}_{22}$ composing a part of the display device. The organic EL display device are provided with data electrode elements (first electrode elements) $\mathbf{32}_1$ and $\mathbf{32}_2$, and scanning electrode elements (second electrode elements) $\mathbf{34}_1$ and $\mathbf{34}_2$. Each electrode element connects to a switching element that conducts a push-pull type operation. The operation of the switching elements is equivalently represented by switches $\mathbf{22}_1$, $\mathbf{22}_2$, $\mathbf{42}_1$, and $\mathbf{42}_2$. Switches $\mathbf{22}_1$ and $\mathbf{22}_2$ conduct switching of data electrode elements $\mathbf{32}_1$ and $\mathbf{32}_2$ between connection to display current sources $\mathbf{24}_1$ and $\mathbf{24}_2$ and connection to the ground 26. Switches $\mathbf{42}_1$, and $\mathbf{42}_2$ conduct switching of scanning electrode elements $\mathbf{34}_1$ and $\mathbf{34}_2$ between connection to ground 46, or the first power supply which is used in place of the ground, and connection to variable voltage power supply 44, which is a second power supply. When a scanning electrode element is selected, the scanning electrode element is connected to ground 46; when a scanning electrode element is not selected, the scanning electrode element is connected to variable voltage power supply 44. Switches $\mathbf{22}_1$ and $\mathbf{22}_2$ compose a first driving unit 20; switches $\mathbf{42}_1$, $\mathbf{42}_2$, and variable voltage power supply 44 compose second driving unit 40. This aspect of embodiment can be applied to, for example, an organic EL display device panel with pixels of 80×60 dots and a pixel pitch of 0.33×0.33 mm. First driving unit 20 and second driving unit 40 can be constructed using a driver IC or a power supply circuit with maximum voltage on the electrode of 15 V. A high voltage side of switching elements of first driving unit 20 can be, for example, a circuit of 100 μA constant current operation supplying a maximum voltage of 15 V.

In organic EL display device 10 of the embodiment of the invention, the voltage Vs of variable voltage power supply 44 supplied to the switching elements of the side of scanning electrode elements $\mathbf{34}_1$ and $\mathbf{34}_2$ is varied in synchronism with the potential variation at data electrode elements $\mathbf{32}_1$ and $\mathbf{32}_2$ of the lighting pixels. When the power supply voltage Vs is varied following-up and in the same value as the potential of data electrode elements $\mathbf{32}_1$ and $\mathbf{32}_2$, unnecessary charging and discharging do not occur in the pixels connecting to the unselected scanning electrode elements (scanning electrode element $\mathbf{34}_2$ in the example of FIG. 1). Consequently, effective power supply is performed to organic EL light emitting elements $\mathbf{30}_{11}$, and $\mathbf{30}_{12}$ connecting to the selected scanning electrode element (scanning electrode element $\mathbf{34}_1$ in FIG. 1). Thus, unnecessary charging and discharging are avoided and the power consumption is suppressed to a low level.

In organic EL display device 10 of the embodiment of the invention, switches $\mathbf{22}_1$ and $\mathbf{22}_2$ operate during a period when either one of scanning electrode elements $\mathbf{34}_1$ and $\mathbf{34}_2$ is selected. Data electrode elements $\mathbf{32}_1$ and $\mathbf{32}_2$ are connected to display current sources $\mathbf{24}_1$ and $\mathbf{24}_2$ through switches $\mathbf{22}_1$ and $\mathbf{22}_2$ only within the duration of light emission out of the selected period. Thus, in the present invention, at the moment of switching between the scanning electrode elements by switches $\mathbf{42}_1$ and $\mathbf{42}_2$, data electrode elements $\mathbf{32}_1$ and $\mathbf{32}_2$ are connected to ground 26 by switches $\mathbf{22}_1$ and $\mathbf{22}_2$.

A voltage Vs of variable voltage power supply 44 is not limited in this example of embodiment. A low potential side of the switching elements in the data electrode side is not limited to the ground potential but can be at another potential.

Figure 5:
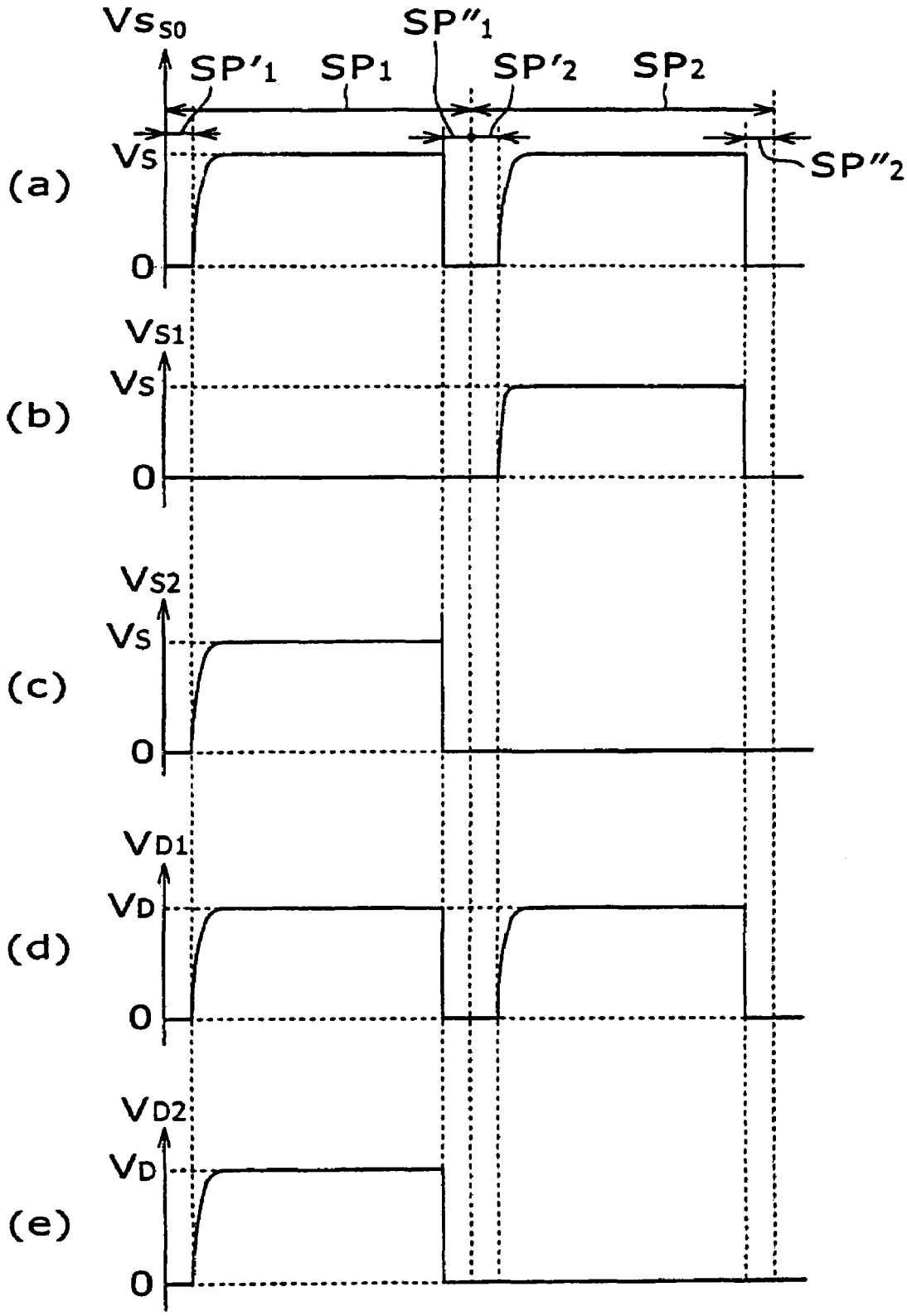
FIG. 5 is a timing chart showing voltage wave forms in an organic EL display device of an embodiment according to the invention.

FIG. 5 is a timing chart showing voltage of variable voltage power supply 44, voltages of scanning electrode elements 34, and the voltages of data electrode elements 32 over the period SP1 in which scanning electrode element $\mathbf{34}_1$ is selected and the period SP2 in which scanning electrode element $\mathbf{34}_2$ is selected. FIG. 5 illustrates voltage $VS_{SO}$ of variable voltage power supply 44 (FIG. 5*a*), voltage Vs1 of scanning electrode element $\mathbf{34}_1$ (FIG. 5*b*), voltage Vs2 of scanning electrode element $\mathbf{34}_2$ (FIG. 5*c*), voltage Vd1 of data electrode element $\mathbf{32}_1$ (FIG. 5*d*), and voltage Vd2 of data electrode element $\mathbf{32}_2$ (FIG. 5*e*) versus a common time scale.

This embodiment of the invention is described below referring to the state of switches in FIGS. 1 through 4 and the timing charts in FIG. 5.

The switches in FIG. 1 are in an intermediate state within the period SP1 in FIG. 5. In this period, scanning electrode element $\mathbf{34}_1$ is selected, that is, scanning electrode element $\mathbf{34}_1$ is connected to ground 46 by switch $\mathbf{42}_1$. Scanning electrode element $\mathbf{34}_2$ is unselected, that is, scanning electrode element $\mathbf{34}_2$ is connected to variable voltage power supply 44 by switch $\mathbf{42}_2$. Data electrode elements $\mathbf{32}_1$ and $\mathbf{32}_2$ are connected to display current sources $\mathbf{24}_1$ and $\mathbf{24}_2$ by switches $\mathbf{22}_1$ and $\mathbf{22}_2$.

In this state of the switches, organic EL light emitting elements $\mathbf{30}_{11}$ and $\mathbf{30}_{12}$ of the pixels connecting to scanning electrode element $\mathbf{34}_1$ emit light, and organic EL light emitting elements $\mathbf{30}_{21}$ and $\mathbf{30}_{22}$ of the pixels connecting to scanning electrode element $\mathbf{34}_{2\ do}$ not emit light. In this aspect of embodiment, variable voltage power supply 44 outputs a voltage $Vs_{SO}$ that varies in synchronism with the operation of switches 22. The wave form of the voltage $Vs_{SO}$ exhibits a delay in the rising stage, which reflects the following-up to the voltage wave form of display current source 24 charging the capacitor components.

In FIG. 1, every data electrode element that crosses the selected scanning electrode element $\mathbf{34}_1$ are in constant current driving and the organic EL light emitting elements connecting these electrode elements are lit. In this period, the electric potential of variable voltage power supply 44 connecting to the switching elements along the unselected scanning electrode elements is set at a potential following-up the potential of the data electrode elements. So, the voltage across the pixels along the unselected scanning electrode element is held at zero volts. Thus, in this state, charging and discharging to the pixels along the unselected scanning electrode elements do not occur and the power supplied to the data electrode elements is fully utilized to light the light emitting elements.

Figure 2:
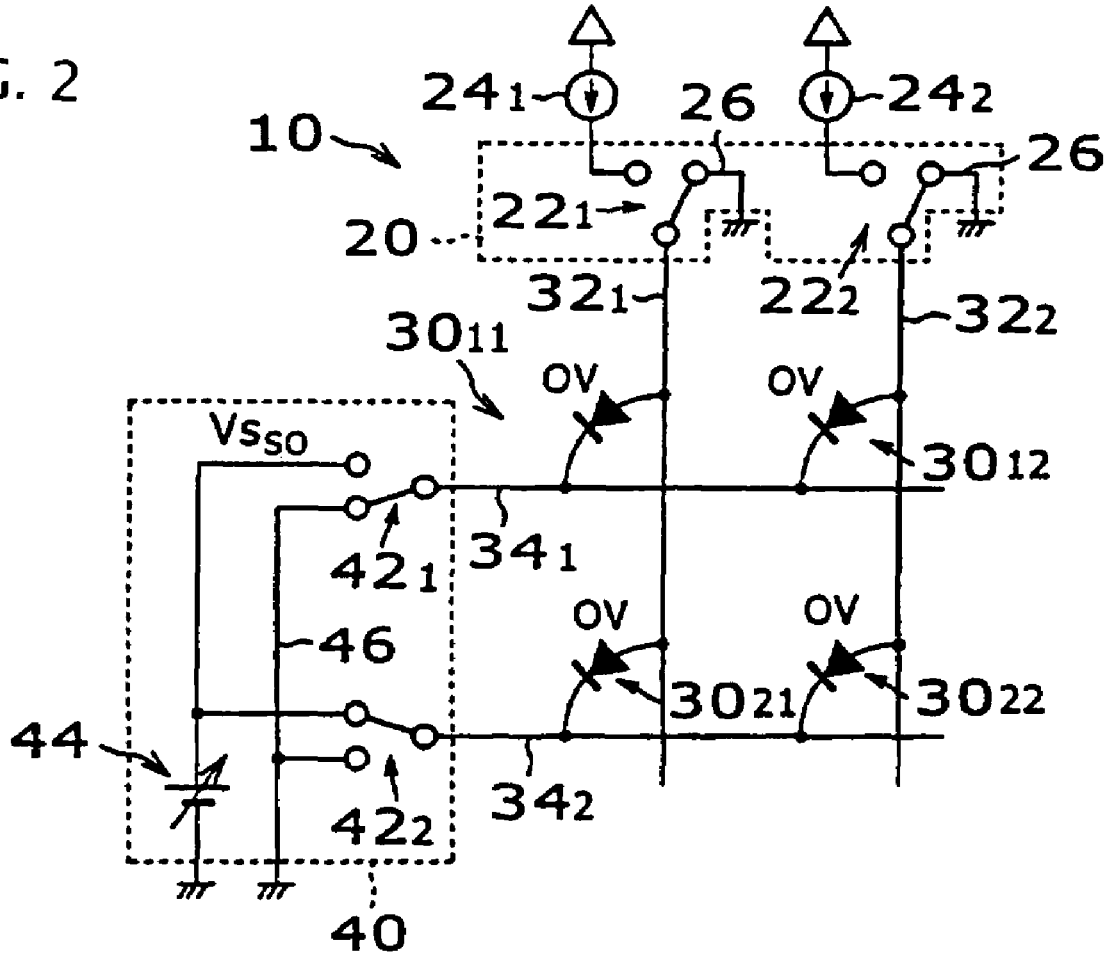
FIG. 2 is a circuit diagram showing a part of a structure of an organic EL display device of an embodiment according to the invention, and shows a state of switches that comes on following the state of FIG. 1.

The state of switches in FIG. 2 is produced subsequently following the state of FIG. 1 and is the state during the period SP"1 in FIG. 5. In this state, scanning electrode element $\mathbf{34}_1$ continues to be selected, that is, scanning electrode element $\mathbf{34}_1$ is connecting to ground 46 by switch $\mathbf{42}_1$. Scanning electrode element $\mathbf{34}_2$ is unselected, that is, scanning electrode element $\mathbf{34}_2$ is connected to variable voltage power supply 44 by switch $\mathbf{42}_2$. Data electrode elements $\mathbf{32}_1$ and $\mathbf{32}_2$ are connected to ground 26 by switches $\mathbf{22}_1$ and $\mathbf{22}_2$.

In this state of switches, none of the organic EL light emitting elements $\mathbf{30}_{11}$, $\mathbf{30}_{12}$, $\mathbf{30}_{21}$, and $\mathbf{30}_{22}$ emit light and none are subjected to either forward or reverse voltage.

In the transition from the state of FIG. 1 to the state of FIG. 2, the voltage of variable voltage power supply 44 falls in synchronism with the fall of the potential of data electrode elements $\mathbf{32}_1$ and $\mathbf{32}_2$. Owing to this operation, transfer of charges does not occur in organic EL light emitting elements $\mathbf{30}_{21}$, and $\mathbf{30}_{22}$ connecting to the unselected scanning electrode element $\mathbf{34}_2$. Thus, charge transfer that does not contribute to light emission is avoided.

Figure 3:
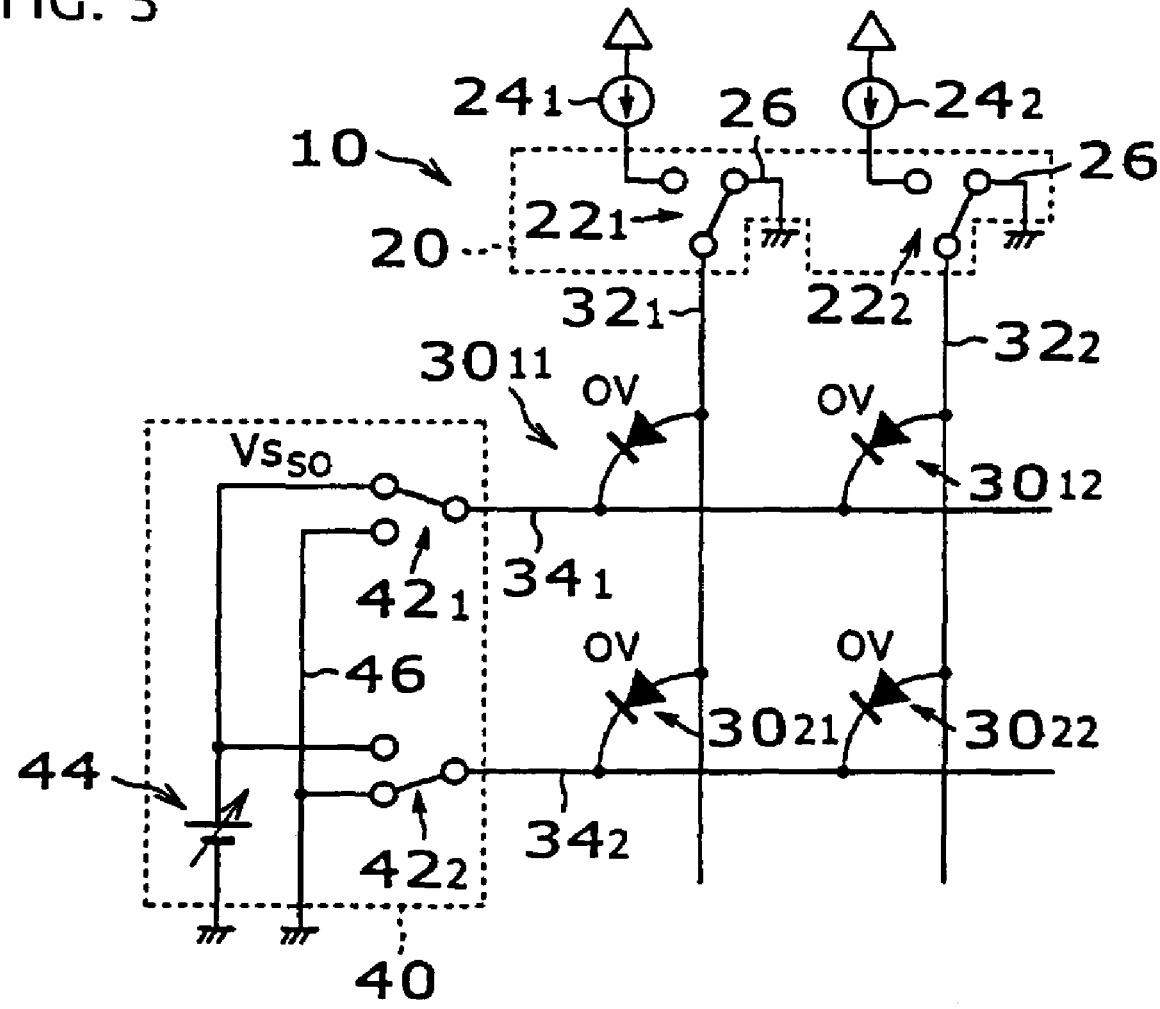
FIG. 3 is a circuit diagram showing a part of a structure of an organic EL display device of an embodiment according to the invention, and shows a state of switches that comes on following the state of FIG. 2.

The state of switches in FIG. 3 is produced subsequently following the state of FIG. 2 and is the state during the period SP'2 in FIG. 5. In this state, scanning electrode element $\mathbf{34}_1$ is unselected, that is, scanning electrode element $\mathbf{34}_1$ is connected to variable voltage power supply 44 by switch $\mathbf{42}_1$. In place of scanning electrode element $\mathbf{34}_1$, scanning electrode element $\mathbf{34}_2$ is unselected, that is, scanning electrode element $\mathbf{34}_2$ is connected to ground 46 by switch $\mathbf{42}_2$. Data electrode elements $\mathbf{32}_1$ and $\mathbf{32}_2$ are connected to ground 26 by switches $\mathbf{22}_1$ and $\mathbf{22}_2$.

In this state of switches, similar to the state in FIG. 2, none of the organic EL light emitting elements $\mathbf{30}_{11}$, $\mathbf{30}_{12}$, $\mathbf{30}_{21}$, and $\mathbf{30}_{22}$ emit light and none are subjected to either forward or reverse voltage. Because the voltage of variable voltage power supply 44 in FIG. 3 is also equal to the voltage of the data electrode elements $\mathbf{32}_1$ and $\mathbf{32}_2$, charging and discharging to and from organic EL light emitting elements $\mathbf{30}_{11}$, $\mathbf{30}_{12}$, $\mathbf{30}_{21}$, and $\mathbf{30}_{22}$ do not occur.

Figure 4:
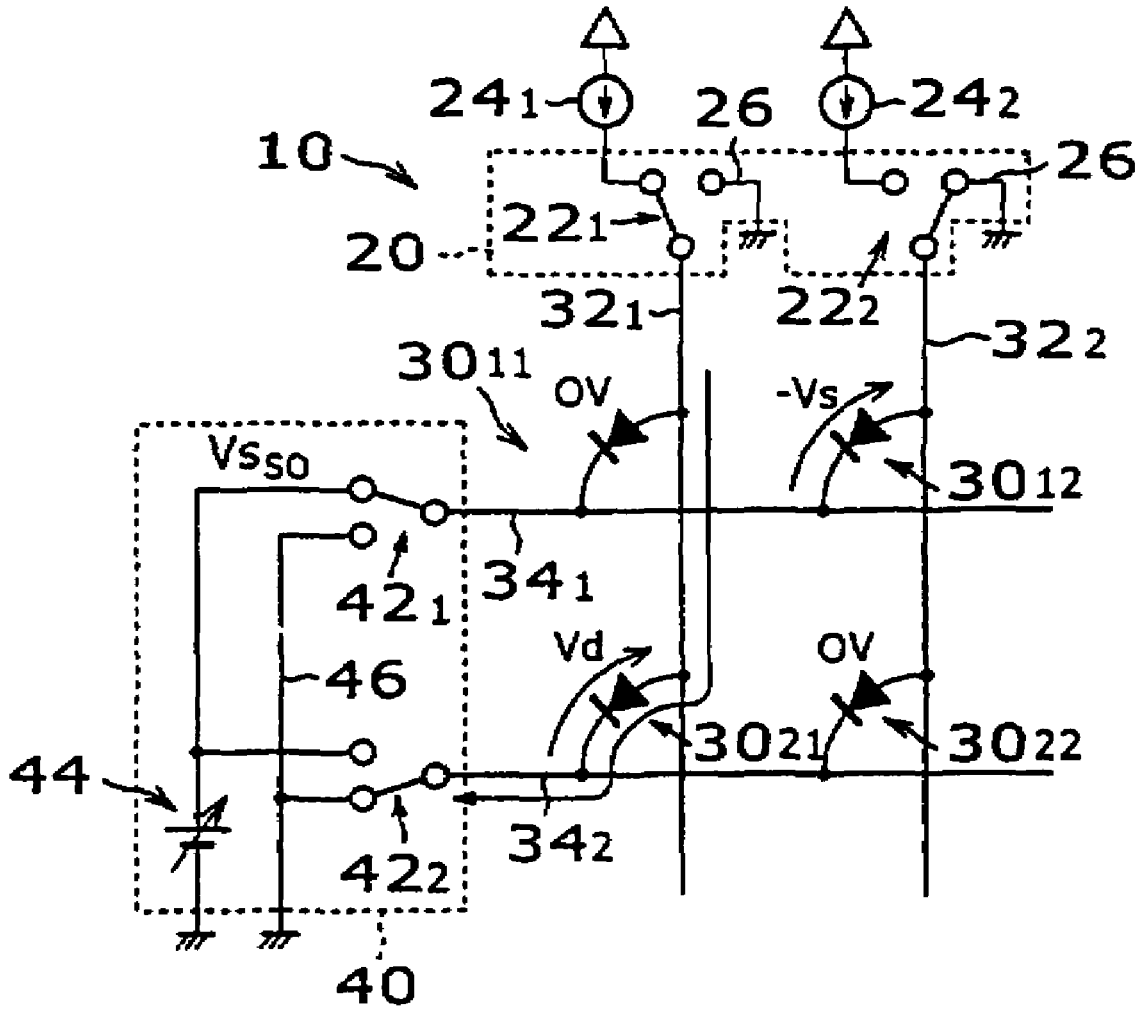
FIG. 4 is a circuit diagram showing a part of a structure of an organic EL display device of an embodiment according to the invention, and shows a state of switches that comes on following the state of FIG. 3.

The state of switches in FIG. 4 is produced subsequent to the state of FIG. 3 and is the intermediate state within the period SP2 in FIG. 5. In this state, scanning electrode element $\mathbf{34}_1$ continues to be unselected as in FIG. 3, that is, scanning electrode element $\mathbf{34}_1$ is connected to variable voltage power supply 44 by switch $\mathbf{42}_1$. Scanning electrode element $\mathbf{34}_2$ is selected, that is, scanning electrode element $\mathbf{34}_2$ is connected to ground 46 by switch $\mathbf{42}_2$. Data electrode element $\mathbf{32}_1$ is connected to display current source $\mathbf{24}_1$ by switch $\mathbf{22}_1$, and data electrode element $\mathbf{32}_2$ is connected to ground 26 by switch $\mathbf{22}_2$.

In this state of switches, organic EL light emitting elements $\mathbf{30}_{11}$, $\mathbf{30}_{12}$, and $\mathbf{30}_{22}$ do not emit light and organic EL light emitting element $\mathbf{30}_{21}$ does emit light. Organic EL light emitting element $\mathbf{30}_{21}$ is subjected to the forward voltage Vd. Organic EL light emitting element $\mathbf{30}_{12}$ is subjected to the reverse bias voltage −Vs. In FIG. 4, similar to FIG. 1, the data electrode element connecting to the pixels to be lighted is driven in a constant current. In the transition from the state of FIG. 3 to the state of FIG. 4, the voltage of the variable voltage power supply is set following-up the voltage of the data electrode element to be lighted. The data electrode to be followed-up is not necessarily a special data electrode element(s), but can be at least one of the plural data electrode elements in constant current driving. When first driving unit 20 is working with driver ICs, the switching state of the driver ICs are monitored and corresponding to the monitored state, the voltage of variable voltage power supply 44 connecting to the switching element of the scanning electrode element can be varied.

By setting the voltage of the power supply connecting to the switching element of the unselected scanning electrode element to follow-up the potential of the data electrode element, the voltage across the unselected pixels can be held at zero and the number of pixels that are subjected to a reverse bias voltage can be reduced. Thus, an organic EL display device with reduced power consumption is provided.

Second Aspect of Embodiment

Figure 6:
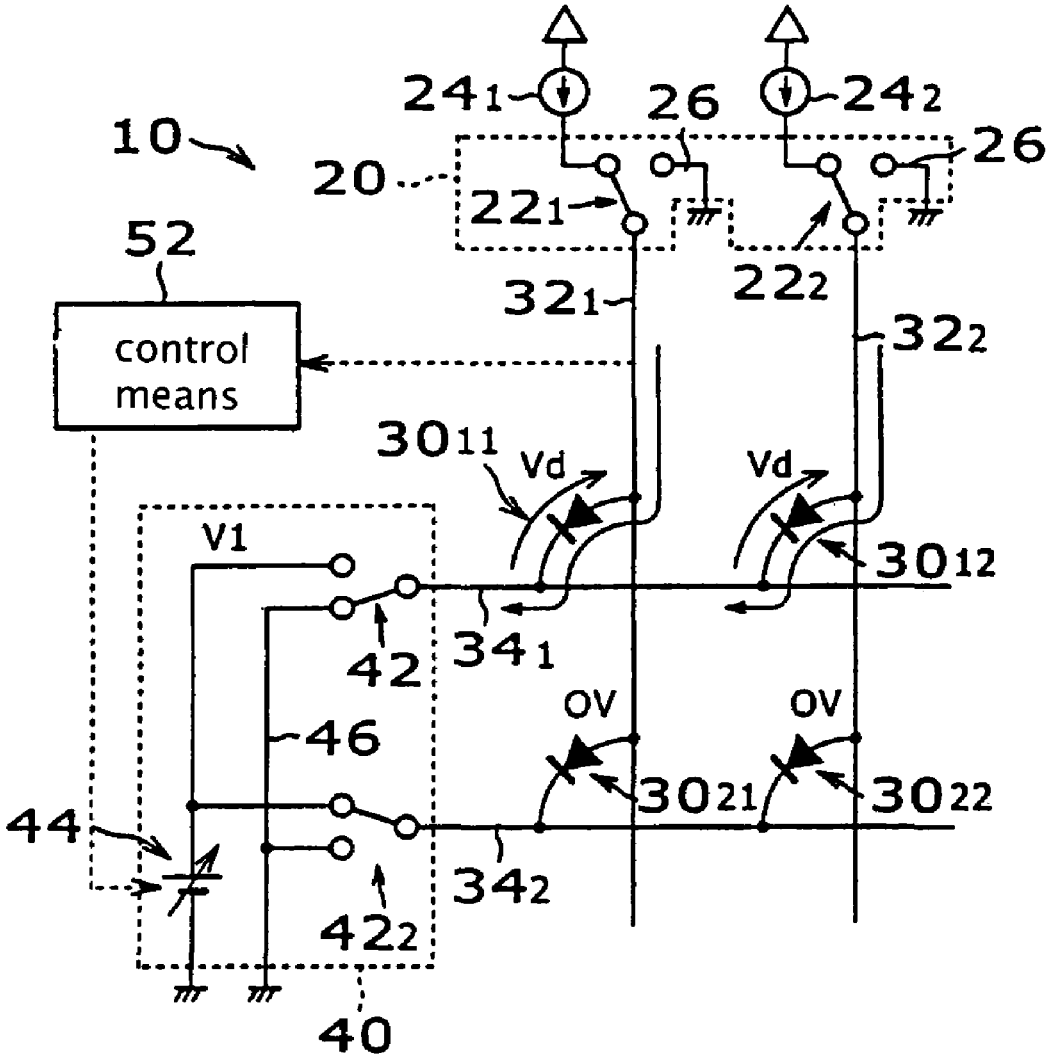
FIG. 6 shows a structure of an organic EL display device of an embodiment according to the invention.

FIG. 6 shows a structure of an organic EL display device of another embodiment according to the invention. In this embodiment, the voltage wave form of first electrode elements that connect to the organic EL light emitting elements to be lighted is monitored to control variable voltage power supply 44, which is a second power supply.

In this embodiment, the voltage variation Vs of variable voltage power supply 44 coincides with the voltage variation Vd of display current source 24. Consequently, this embodiment is provided with control means 52 that monitors the wave form on the data electrode element connecting to the pixels to be lighted and generates control signals to control so that the voltage wave form of variable voltage power supply 44 coincides with the monitored wave form on the data electrode element. If the voltage Vs is made exactly same as the voltage Vd, the reverse bias voltage can be made to be zero volts on organic EL light emitting elements $\mathbf{30}_{21}$ and $\mathbf{30}_{22}$ in FIG. 1 and organic EL light emitting element $\mathbf{30}_{11}$ in FIG. 4. Regarding the data electrode elements that are not in the constant current driving, the organic EL light emitting elements are subjected to a reverse bias voltage −Vs, like light emitting element $\mathbf{30}_{12}$ in FIG. 4.

Third Aspect of Embodiment

Figure 7:
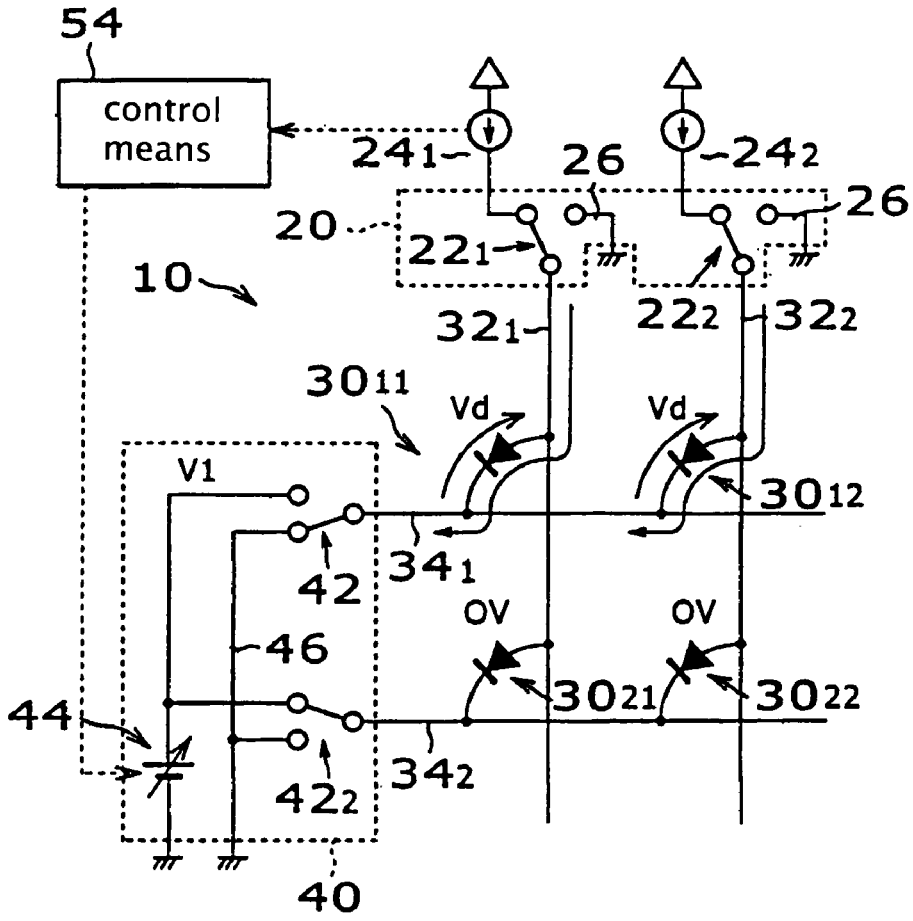
FIG. 7 shows a structure of an organic EL display device of an embodiment according to the invention.
Figure 8:
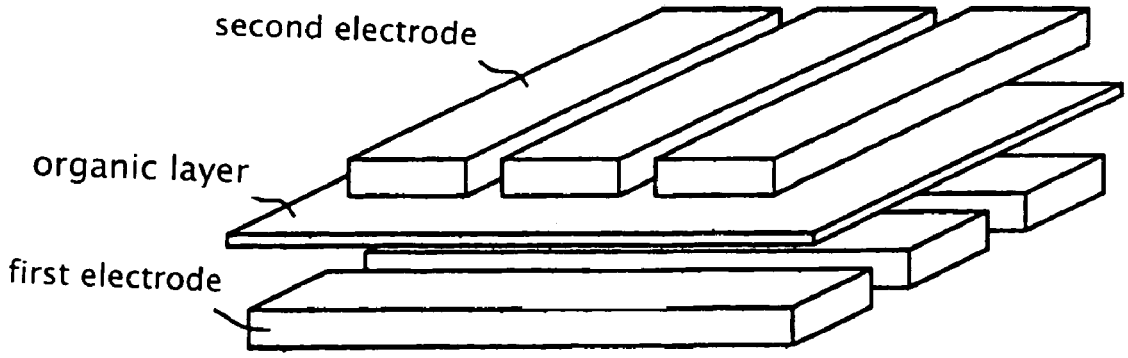
FIG. 8 shows an example of electrode structure of a common passive matrix type organic EL display device.
Figure 9:
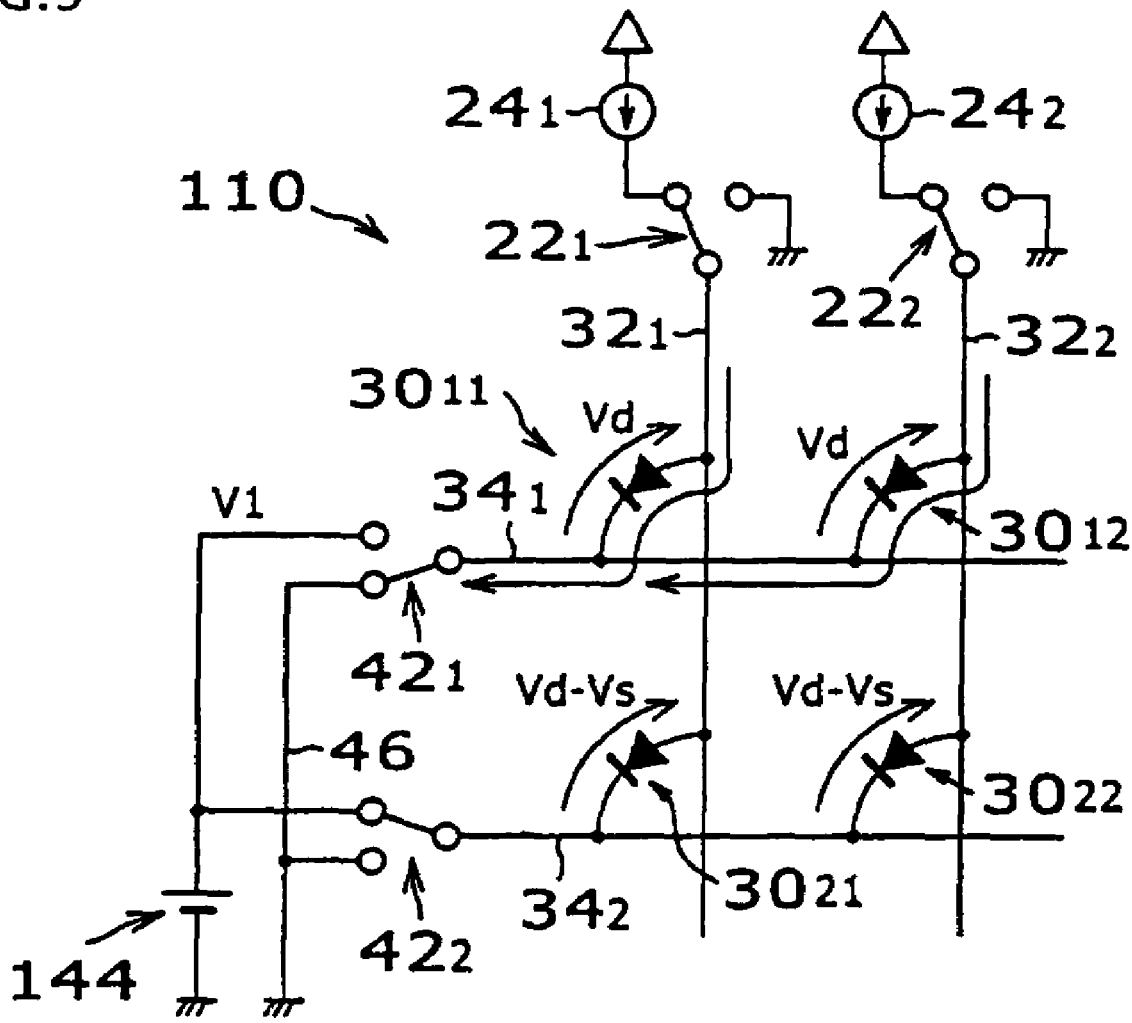
FIG. 9 is a circuit diagram showing a part of a structure of an organic EL display device of a comparative example, and shows a state of switches in the intermediate stage in the selected period.

FIG. 7 shows a structure of an organic EL display device of third embodiment according to the invention. In this embodiment, variable voltage power supply 44, which is a second power supply, is controlled corresponding to the current from display current source 24.

This embodiment, in the case where display current source 24 is a constant current source, utilizes the fact that the delayed rising of the voltage wave form (FIG. 5) associated with driving a load can be determined from the output current value of current source 24. Thereby, the wave form of the voltage Vs of variable voltage power supply 44 can be made to coincide with the wave form of the voltage Vd of display current source 24. Consequently, this embodiment is provided with control means 54 that generates a control signal to control the delayed rising waveform of the voltage of variable voltage power supply 44.

COMPARATIVE EXAMPLE

Organic EL display device 110 as a comparative example was manufactured having the number of pixels of 80×60 dots and the pixel pitch of 0.33×0.33 mm. The upper limit of the voltage was 15 V in the driver unit to drive the data electrode elements and in the driver unit to drive the scanning electrode elements, in the comparative example. The display current source in the driver unit to drive the data electrode element is a 100 μA constant current operation circuit that can provide 15 V at the maximum.

FIGS. 9 through 12 are, corresponding to FIGS. 1 through 4, circuit diagrams illustrating the operation of organic EL display device 110. In FIGS. 9 through 12, the same symbols are used as in FIGS. 1 through 4, for the similar components to those in FIGS. 1 through 4. In the organic EL display device of this comparative example, every data electrode element on the selected scanning electrode element is driven in a constant current mode and every organic EL light emitting element connecting to the selected scanning electrode element is lit. The voltage of the power supply connecting to the switching elements of the unselected scanning electrode element 34 is fixed to 15 V, and the voltage across the organic EL light emitting elements on the unselected scanning electrode elements 34 is the difference Vd−Vs from the voltage Vd that arises at data electrode elements $\mathbf{32}_1$ and $\mathbf{32}_2$. Consequently, charging and discharging of the charges in the amount of C (Vd−Vs) occur in this state, where C is a capacitor component of the organic EL light emitting elements. The voltages Vd1 and Vd2 of data electrode elements $\mathbf{32}_1$ and $\mathbf{32}_2$ are zero at the start of constant current driving, and the charging is largest at the moment of switching in the side of the data electrode. This unnecessary charging occurs at all pixels connecting to the unselected scanning electrode element. The number of the pixels is 80 dots×59 lines. The consumed amount of charge is thus substantial.

Figure 10:
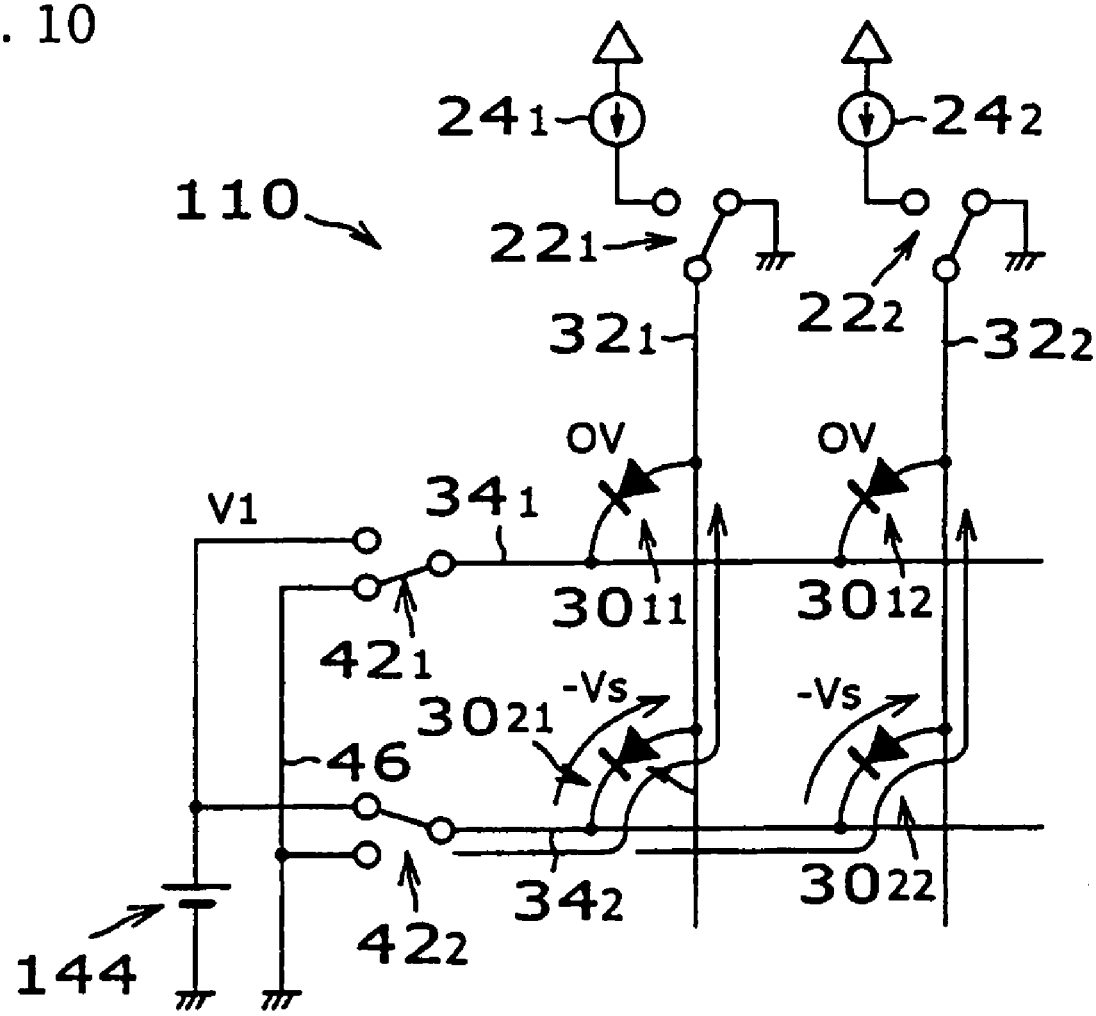
FIG. 10 is a circuit diagram showing a part of a structure of an organic EL display device of a comparative example, and shows a state of switches that comes on following the state of FIG. 9.

In FIG. 10, data electrode elements $\mathbf{32}_1$ and $\mathbf{32}_2$ are connected to ground 26, indicating a quenched state. At this time, the potential difference across the pixels on the unselected scanning electrode element $\mathbf{34}_2$ becomes largest, accumulating a substantial amount of charges without contributing to light emission.

Figure 11:
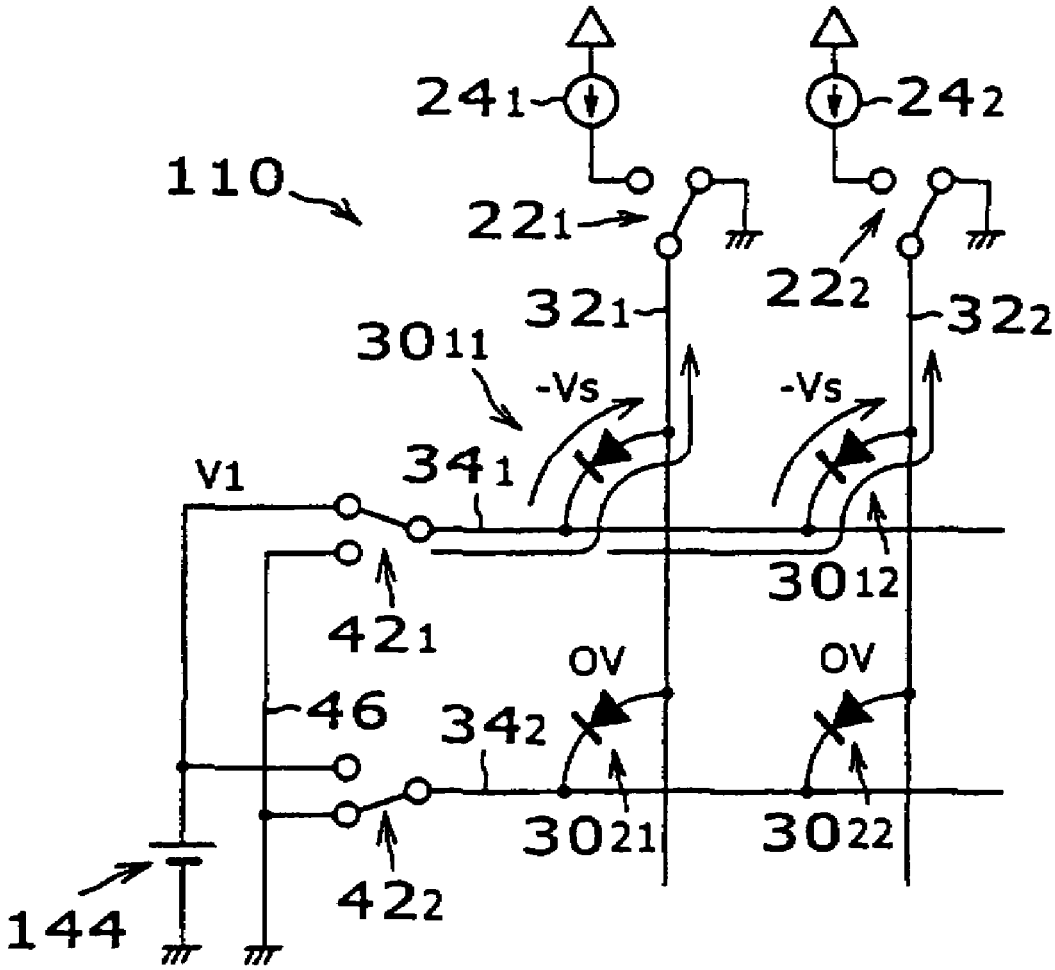
FIG. 11 is a circuit diagram showing a part of a structure of an organic EL display device of a comparative example, and shows a state of switches that comes on following the state of FIG. 10.

In FIG. 11, the selected scanning electrode element is switched to scanning electrode element $\mathbf{34}_2$. At this time, a reverse bias voltage −Vs is applied to scanning electrode element $\mathbf{34}_1$, which is switched from ground 46 to power supply 144. As a result, unnecessary charges are accumulated on organic EL elements $\mathbf{30}_{11}$ and $\mathbf{30}_{12}$. On the other hand, charges are discharged through scanning electrode element $\mathbf{34}_2$, which is switched from power supply 144 to ground 46.

Figure 12:
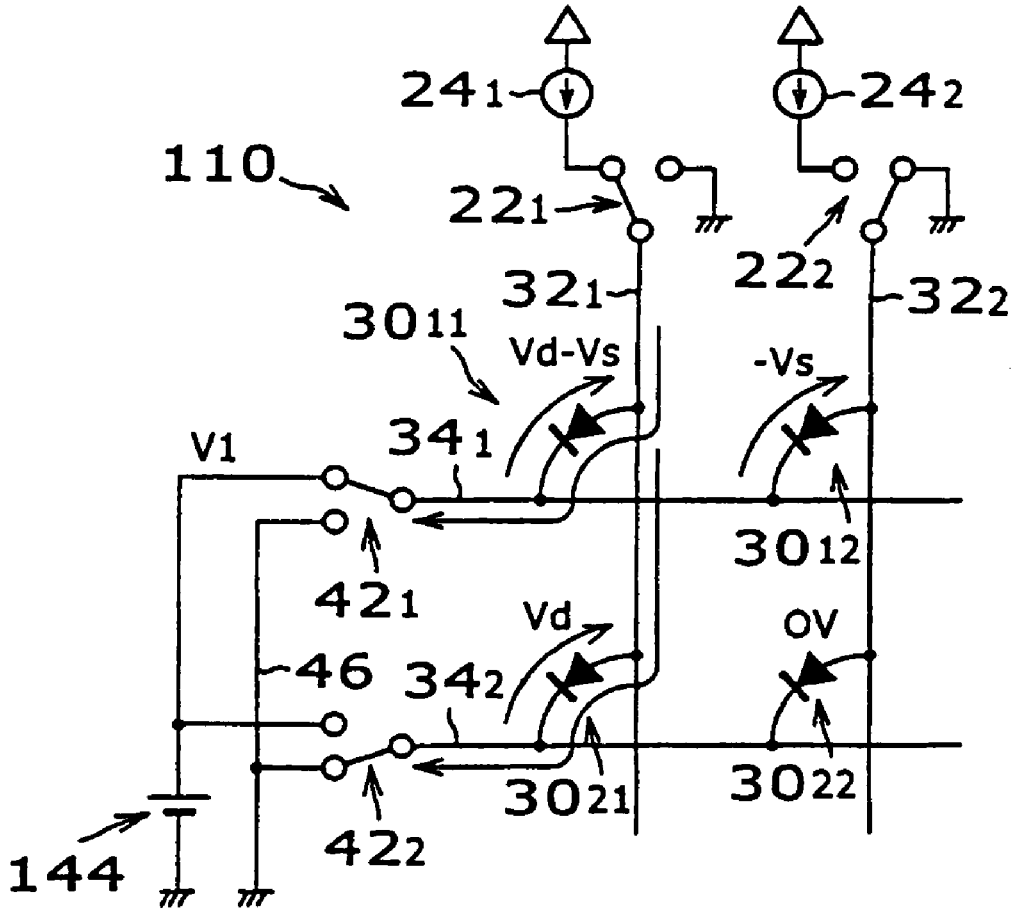
FIG. 12 is a circuit diagram showing a part of a structure of an organic EL display device of a comparative example, and shows a state of switches that comes on following the state of FIG. 11.

In FIG. 12, data electrode element 32, connecting to organic EL light emitting element $\mathbf{30}_{21}$ to be lit is driven in a constant current mode. At this time, the amounts of charges accumulated in the pixels of organic EL light emitting elements $\mathbf{30}_{11}$ that are connected to the unselected scanning electrode element $\mathbf{34}_1$ are the same as the charges accumulated in the pixels of organic EL light emitting elements $\mathbf{30}_{21}$ and $\mathbf{30}_{22}$ in FIG. 9.

As described above, in the structure and operation method of an organic EL display device different from the invention in which the voltage of variable voltage power supply 44 is varied in synchronism with the voltage wave form of the light emitting current, the charging and discharging occur at every time of the switching of the state of FIG. 10 and the state of FIG. 11 in which the data electrode elements and the scanning electrode elements are changed, resulting in increase of power consumption.

Some preferred embodiments according to the invention are described in the foregoing. The present invention, however, is not limited to the examples, but it should be acknowledged that modifications, variations, and combinations are possible within the spirit and scope of the invention.

Thus, an organic EL display device and a method driving such a device have been described according to the present invention. Many modifications and variations may be made to the techniques and structures described and illustrated herein without departing from the spirit and scope of the invention. Accordingly, it should be understood that the devices and methods described herein are illustrative only and are not limiting upon the scope of the invention.

What is claimed is:

1. An organic EL display device comprising:

a plurality of first electrode elements arranged in a shape of stripes;

a plurality of second electrode elements arranged in a shape of stripes and in a direction crossing the first electrode elements, each crossing point forming a pixel;

organic light emitting layers sandwiched by the first electrode elements and the second electrode elements;

a first driving unit that selectively connects each first electrode element to either a data power supply or a reference potential in accordance with a display pattern, wherein the first driving unit connects all of the first electrode elements to the reference potential in a first period of a display cycle, connects selected ones of the first electrode elements to the data power supply and non-selected ones of the first electrode elements to the reference potential in a subsequent second period of the display cycle, and connects all the first electrode elements to the reference potential in a subsequent third period of the display cycle;

a second driving unit that sequentially selects the second electrode elements, one at a time, by connecting a respective selected second electrode element to ground or to a first power supply, while connecting all other second electrode elements, as non-selected second electrode elements, to a second power supply, and that changes the selection to a next selected second electrode element in the first period of each subsequent display cycle, control means for controlling the second power supply in synchronism with the operation of the first driving unit such that the potential it applies to the non-selected second electrode elements is equal to the reference voltage in the first and third periods of the display cycle and is equal to a potential applied to a selected first electrode element in the second cycle of the display cycle;

wherein a potential difference applied to each pixel defined by a selected first electrode element and a selected second electrode element in the second period of the display cycle is such as to cause a light emission current to flow through the light emitting layer sandwiched between the selected first electrode element and the selected second electrode element, and wherein a potential difference applied to any other pixel is such as to prevent light emission current from flowing through the light emitting layer of the pixel.

2. The organic EL display device according to claim 1, wherein the first driving unit generates the light emitting current by constant current sources.

3. A method of operating an EL display that includes a plurality of first electrode elements arranged in a shape of stripes, a plurality of second electrode elements arranged in a shape of stripes and in a direction crossing the first electrode elements, each crossing point forming a pixel, organic light emitting layers sandwiched by the first electrode elements and the second electrode elements, a first driving unit that selectively connects each first electrode element to either a data power supply or a reference potential in accordance with a display pattern, a second driving unit that sequentially selects the second electrode elements, one at a time, by connecting a respective selected second electrode element to ground or to a first power supply, while connecting all other second electrode elements, as non-selected second electrode elements, to a second power supply, and that changes the selection to a next selected second electrode element in the first period of the display cycle, and a control means for controlling the second power supply in synchronism with the operation of the first driving unit, the method comprising:

a.) causing the second driving unit to select one of the second electrode elements by electrically connecting the respective selected second electrode element to the first power supply or to ground while connecting the remaining second electrode elements as non-selected second electrode elements to the second power supply;

b.) connecting, in a first period of the display cycle, all the first electrode elements to a reference potential;

c.) connecting, in a subsequent second period of the display cycle, selected ones of the first electrode elements to the data power supply and the remaining non-selected ones of the first electrode elements to the reference potential;

d.) connecting, in a subsequent third period of the display cycle, all first electrode elements to the reference potential, and e.) repeating steps a) to d) for the next display cycle while selecting another one of the second electrode elements in the first period of the next display cycle;

wherein the voltage of the second power supply is controlled in synchronism with the operation of the first driving unit such that the potential it applies to the non-selected electrode elements is equal to the reference voltage in the first and third periods of each display cycle, and is equal to a potential applied to a selected first electrode element in the second period in each display cycle; and wherein the potential difference applied to each pixel defined by a selected first electrode element and a selected second electrode element in the second period of each display cycle is such as to cause a light emission current to flow through the light emitting layer sandwiched between the selected first electrode element and the selected second electrode element, whereas the potential difference applied to any other pixel is such as to prevent a light emission current from flowing through the light emitting layer of the other pixel.

4. A method as claimed in claim 3, wherein a constant current light emission current flows through the selected first electrode elements.

5. A method as claimed in claim 3, wherein the reference potential is ground.

* * * * *